US006454021B1

(12) United States Patent
Watanabe

(10) Patent No.: US 6,454,021 B1
(45) Date of Patent: Sep. 24, 2002

(54) IMPACT MACHINE

(75) Inventor: Hideshi Watanabe, Tokyo (JP)

(73) Assignee: Furukawa Co., Ltd. (JP)

( * ) Notice: Subject to any disclaimer, the term of this patent is extended or adjusted under 35 U.S.C. 154(b) by 0 days.

(21) Appl. No.: 09/555,655

(22) PCT Filed: Dec. 15, 1998

(86) PCT No.: PCT/JP98/05659

§ 371 (c)(1),
(2), (4) Date: Jun. 1, 2000

(87) PCT Pub. No.: WO99/32266

PCT Pub. Date: Jul. 1, 1999

(30) Foreign Application Priority Data

Dec. 19, 1997 (JP) ..... 9-351150

(51) Int. Cl.[7] ..... B25D 11/00

(52) U.S. Cl. ..... 173/114; 173/112; 173/11; 173/117

(58) Field of Search ..... 173/2, 4, 10, 11, 173/19, 49, 112, 114, 117, 217

(56) References Cited

U.S. PATENT DOCUMENTS 4,033,419 A * 7/1977 Pennington ..... 173/160

5,769,173 A * 6/1998 Egami et al. ..... 173/114

FOREIGN PATENT DOCUMENTS

| | | |
|---|---|---|
| JP | 63-99182 A | 4/1988 |
| JP | 1-272500 A | 10/1989 |
| JP | 6-297303 A | 10/1994 |

* cited by examiner

*Primary Examiner*—Scott A. Smith
*Assistant Examiner*—Nathaniel Chukwurah
(74) *Attorney, Agent, or Firm*—Young & Basile, P.C.

(57) ABSTRACT

The invention provides an impacting device capable of , crushing or drilling work with reduced noise or vibration, with high crushing efficiency, high energy efficiency, increased output and prolonged durability A super magnetostrictive material (1) is arranged in the center of an exciting coil (4) to which a pulse voltage is applied, a rod (12) is arranged in tight contact with the front end of the super magnetostrictive material (1), a reaction-receiving plate (3) is provided in tight contact with the other end of the super magnetostrictive material (1), and a power unit (6) is provided for repeatedly applying a pulse voltage to the exciting coil (4).

9 Claims, 6 Drawing Sheets

IMPACT MACHINE

TECHNICAL FIELD

The present invention relates to an impacting device that utilizes an impact action produced by magnetostriction.

BACKGROUND ART

Heretofore, in impact machines, such as a breaker for crushing concrete or a rock with impacts or a drill for drilling a rock with impacts, the impacting device for imparting impacts to the impact-transmitting tool, a chisel or a rod, for example, has used blows of a piston operated by hydraulic or pneumatic force.

However, in the impacting device such as this, a shock wave (a stress wave, namely, an elastic strain wave) occurs in the impact-transmitting tool, as a result of a blow of the piston, and this shock wave travels toward an object, which is thereby crushed and therefore the sound of a blow and the reaction and vibration resulting from acceleration of the piston have been unavoidable.

When a shock wave is produced, it is necessary to follow a series of processes: electric energy is changed into mechanical energy by a motor, the mechanical energy is changed into kinetic energy of the piston by a hydraulic pump, for example, and the kinetic energy is changed into strain energy of the impact-transmitting tool by a blow of the piston, thus producing a shock wave. The energy efficiency has not been so high.

To make the piston having a large inertial resistance reciprocate at high speed, the accelerating force by hydraulic or pneumatic pressure has not been sufficient and there is a limit to increasing the number of blows, so that it has been not easy to increase output.

It has been known that there is a best waveform of a shock wave adequate for the crushing characteristics (penetration resistance) of each object. Unless the waveform of the shock wave is adequate, the impact-transmitting tool is unable to attain sufficient penetration into the object, reducing the crushing efficiency and increasing reflection of the shock wave from the object which partly contributes to increasing effects to the impacting device and reducing the durability of the impact machine. To control the waveform of a shock wave, measures have been taken, such as changing the shape of the piston to suit an object, but changing the piston shape is troublesome indeed.

DISCLOSURE OF THE INVENTION

The present invention has been made to solve the above problems and has as its object to provide an impacting device for crushing and drilling with low noise and vibration, which features high crushing efficiency, improved energy efficiency, high output and prolonged durability.

In the impacting device according to the present invention, the above problems have been solved by arranging a super magnetostrictive material in the center of the exciting coil to which a pulse voltage is applied, arranging an impact transmitting tool in contact with the front end of the super magnetostrictive material, and placing a reaction-receiving plate in contact with the other end of the super magnetostrictive material.

Magnetostriction is a phenomenon whereby the outside diameter dimension of a ferromagnetic body, such as iron, changes when it is magnetized. In contrast to strain of magnetic metals, which is no more than $10^{-5}$ to $10^{-6}$, magnetostrictive materials exhibit strain on the order of $10^{-3}$ by magnetostriction.

In this impacting device, a pulse voltage is applied to an exciting coil, and by an exciting current flowing in the exciting coil, the super magnetostrictive material is given changes of magnetic field so that the super magnetostrictive material produces such magnetostriction as to give a desired impact waveform. The impacting device transmits the shockwave through the impact-transmitting tool to an object, which is thereby crushed.

The impacting device according to the present invention converts electric energy directly into strain energy and therefore has a high energy efficiency ratio. And, because it does not require hydraulic equipment, hydraulic piping and complicated mechanical devices, such as a hydraulic striking mechanism, this impacting device makes it possible to simplify the impact machine.

To make the impact-transmitting tool penetrate into an object, such as a rock, with energy of a shock wave, it is necessary to maintain the displacement speed higher than a certain speed and longer than a certain period of time. Objects of rock and stone to be crushed are diverse in physical properties and therefore they have various levels of penetration resistance. To ensure an amount of penetration greater than a certain value and to limit required power to a certain value or less, based on the facts that strain by magnetostriction is proportional to the strength of a magnetic field, namely, the magnitude of an exciting current and that the temporal change rate of strain is equal to displacement speed, a pulse voltage is repeatedly applied to the exciting coil such that the exciting current of the exciting coil increases with passage of a voltage-applied time and after reaching a desired maximum value, suddenly drops to zero. Consequently, the super magnetostrictive material reaches desired displacement and displacement speed in its deformation by magnetostriction. The pulse width at this time is suitably selected from a range of several tens of $\mu$s up to several hundreds of $\mu$s, while the pulse interval is suitably selected from a range of several ms up to several hundreds of ms.

When carrying out penetration of the impact-transmitting tool, the leading end of it is preferably in contact with an object. If the leading end of the impact-transmitting tool is not in contact with the object, the shock wave returns as a tensile stress wave through the impact-transmitting tool, making it impossible to effectively transmit energy to the object. For this reason, it is necessary to have the whole impact-transmitting tool statically pressed against the object.

If a pulse voltage is applied to the exciting coil such that the exciting current of the exciting coil increases with passage of the voltage-applied time, and after reaching a desired maximum value, maintains the maximum value for a specified time, so long as the exciting current maintains a fixed value, the super magnetostrictive material is prolonged and the impact-transmitting tool can be pressed against the object. The time for maintaining the exciting current at a fixed value is suitably selected from a range less than several tens of ms.

To make effective use of a shock wave for penetration work of the impact-transmitting tool into the object, it is important to minimize the occurrence of reflected waves.

If a pulse voltage is applied to the exciting coil such that the exciting current of the exciting coil increases in proportion to an elapsed time squared or approximately as a logarithmic function during passage of a voltage-applied time from the initial value to the maximum value, then the occurrence of reflected waves can be reduced.

If a detection coil is provided adjacent to the exciting coil and if, on arrival of a reflected wave at the super magnetostrictive material from the impact-transmitting tool, changes in the current or voltage produced by magnetostriction are measured by the detection coil and the waveform of the reflected wave is detected by a detection unit and the magnitude of an incident wave in the penetration process of the impact-transmitting tool into the object is adjusted according to the reflected wave, then the occurrence of reflected waves can be reduced, which makes it possible to improve the penetration efficiency and decrease vibration and reaction.

BEST MODE FOR CARRYING OUT THE INVENTION

Figure 1:
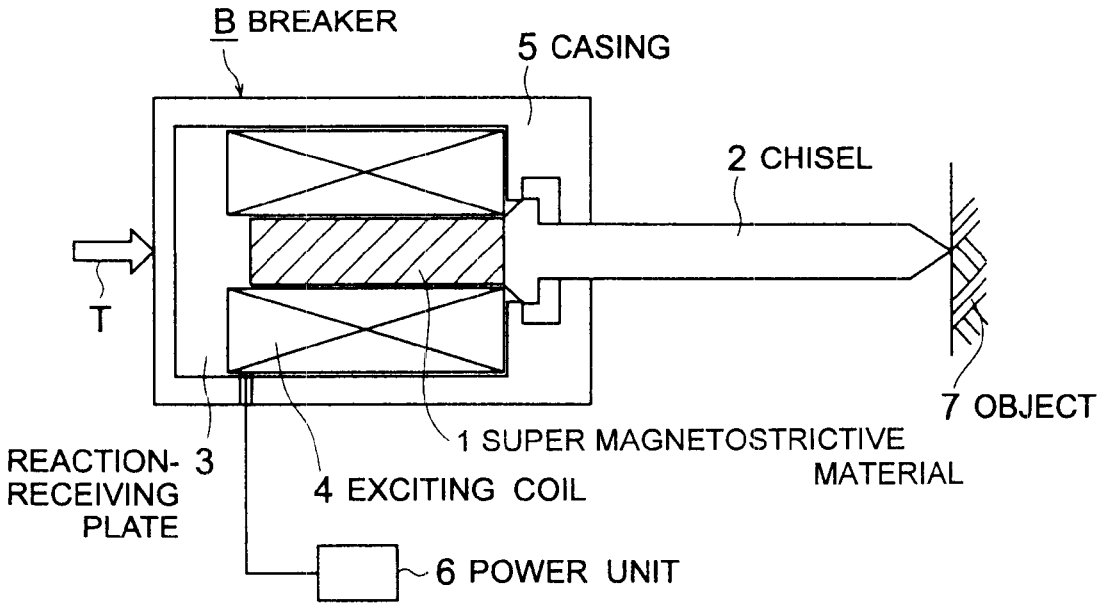
FIG. 1 is a schematic illustration of a breaker using an impacting device according to an embodiment of the present invention.
Figure 2:
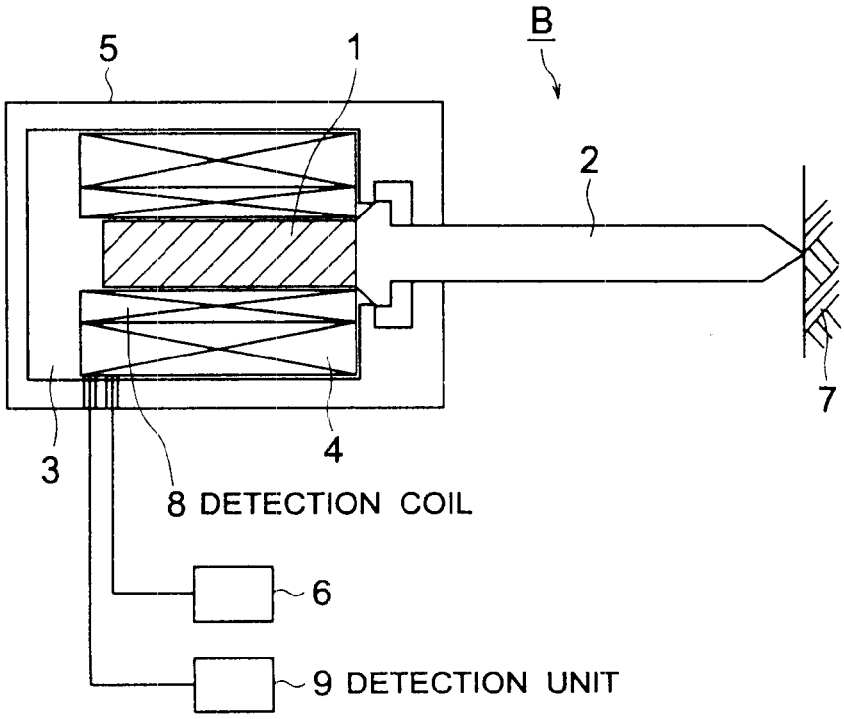
FIG. 2 is a schematic illustration of a breaker having a detection unit of reflected waves according to another embodiment of the present invention.
Figure 3:
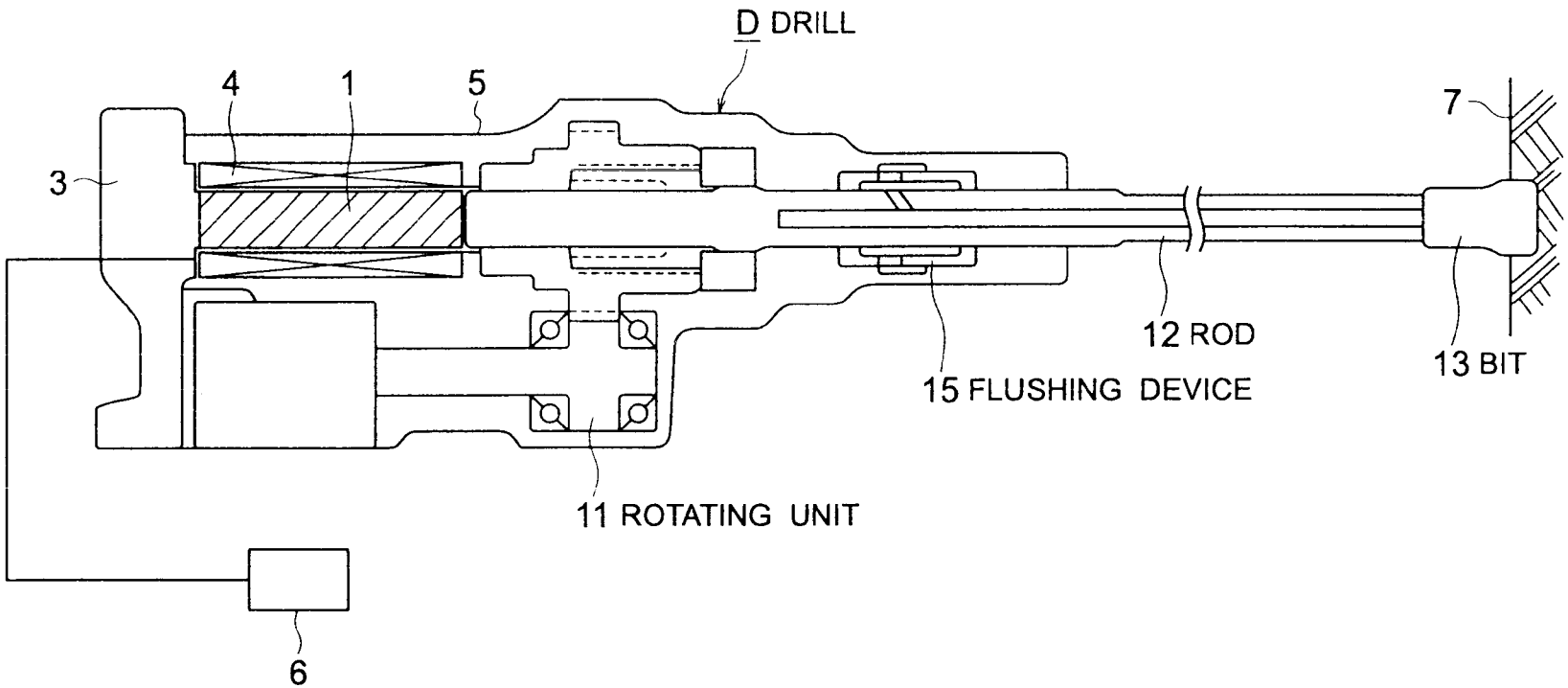
FIG. 3 is a schematic illustration of a drill using an impacting device according to a further embodiment of the present invention.

FIG. 1 is a schematic illustration of a breaker using an impacting device according to an embodiment of the present invention. FIG. 2 is a schematic illustration of a breaker having a detection unit of reflected waves according to another embodiment of the present invention. FIG. 3 is a schematic illustration of a drill using an impacting device according to a further embodiment of the present invention.

In a breaker B in FIG. 1, a super magnetostrictive material 1 is arranged in the center of an exciting coil 4 provided in a casing 5. A chisel 2 as an impact-transmitting, tool is arranged in contact with the front end of the super magnetostrictive material 1, and a reaction-receiving plate 3 is placed in contact with the other end of the super magnetostrictive material 1. In crushing work, the breaker B is given a thrust T by a thrust unit (not shown), the tip of the chisel 2 is pressed against an object 7, and a power unit 6 applies a pulse voltage to the super magnetostrictive material 1.

In crushing work, the breaker B is given a thrust T by a thrust unit (not shown), the tip of the chisel 3 is pressed against an object 7, and a power unit 6 applies a pulse voltage to the super magnetostrictive material 1.

When a pulse voltage is applied to the exciting coil 4, the super magnetostrictive material 1 is given changes in magnetic field by an exciting current flowing through the exciting coil 4, and such magnetostriction occurs as produces a desired impact waveform. The shock wave is transmitted to the object 7 through the chisel 2 placed in contact with the front end of the super magnetostrictive material 1, and the object is crushed by the shock wave.

As the thrust unit, any of those types which have been used with the conventional impact machine, such as a gravity, hydraulic, pneumatic, mechanical or manual type, can be used. To protect the super magnetostrictive material 1, it is preferable to install an non contact striking preventive means that turns on or off the power unit 6 by detecting the thrust of the thrust unit.

In a breaker B in FIG. 2, a detection coil 8 is provided between the super magnetostrictive material 1 and the exciting coil 4, and the detection unit 9 detects the waveform of a reflected wave by measuring changes in a current or a voltage generated by magnetostriction with the detection coil 8 when the reflected wave coming from the chisel 2 arrives at the super magnetostrictive material 1. The other components of this breaker are the same as those of the breaker in FIG. 1.

In a drill D in FIG. 3, a super magnetostrictive material 1 is arranged in the center of an exciting coil 4 provided in a casing 5, and a rod 12 as the impact-transmitting tool is arranged in contact with the front end of the super magnetostrictive material 1. A bit 13 is attached to the leading end of the rod 12. The drill D is equipped with a rotating unit 11 and a flushing unit 15, the rod 12 is rotated by the rotating unit 11 and the flushing unit 15 supplies a fluid for ejecting cuttings.

The operation of the impacting device will be described by referring to the drill D in FIG. 3.

Magnetostriction is a phenomenon that the outside diameter dimension of a ferromagnetic body, such as iron, changes when it is magnetized. In contrast to magnetic metals, which show strain of no more than $10^{-5}$ to $10^{-6}$, magnetostrictive materials exhibit strain on the order of $10^{-3}$ by magnetostriction.

The super magnetostrictive material 1. undergoes magnetostriction and serves as a piston to strike the rod 12 and generates a shock wave.

When the rod 12 is sufficiently longer than the piston, the total kinetic energy of the piston is transmitted as a shock wave to the rod 12. The magnitude $\sigma$ (stress) of a shock wave produced at this time is given by $\sigma=(E/C)v$ where Young's modulus of the material of the rod 12 is denoted as E, the speed of a shock wave that travels in the rod, namely, the speed of sound is denoted as C and the speed of displacement of the end face of the rod by a blow is denoted as v.

With ordinary drills, the magnitude of $\sigma$ is about 200 MPa from the durability of the rod and strain is about $10^{-3}$.

If the sectional area of the rod 12 is denoted as A, the load f of the rod 12 by this shock stress $\sigma$ is expressed by $f=\sigma A=(AE/C)v$ The quantity (AE/C) is called the specific impedance of the rod. If this specific impedance is denoted as Z, the f can be expressed as $f=Zv$. In other words, the load f of the rod 12 is the product of the specific impedance Z intrinsic to the rod 12 and the displacement speed v of the rod 12. The shock energy to be transmitted to the rod 12 is not completely imparted to the rod 12, but part of the shock energy is lost by reflection that invariably occurs where the specific impedance Z changes.

The reflectance R of this reflection is expressed by $R=\Delta Z/\Sigma Z$ by using a difference $\Delta Z$ and sum $\Sigma Z$ of the specific impedances Z before and after the plane of reflection. The behavior of the shock wave that has arrived at the leading end of the rod 12 is as follows. when the bit 13 does not contact anything and remains a free end, because the specific impedance Z of the object is 0, the load at the leading end is 0, so $R=(0-Z)/(0+Z)=-1$. The shock energy is not transmitted to the object at all. If the shock wave is a compressive stress wave, $R=-1$ and the sign is changed and the shock energy is reflected 100% as a tensile stress wave.

On the other hand, when the bit 13 is in contact with an object without any deformation at all and forms a fixed end, the reflectance $R=(\infty-Z)/(\infty+Z)=+1$. Because the displacement of the leading end of the bit 13 is 0, no energy is transmitted to the object at all, and the load at the leading end is twice as much as f by mutual superposition of an incident wave and a reflected wave, namely, 2f. Because $R=+1$ at this time, a compressive stress wave is reflected 100% as a compressive stress wave.

Figure 4:
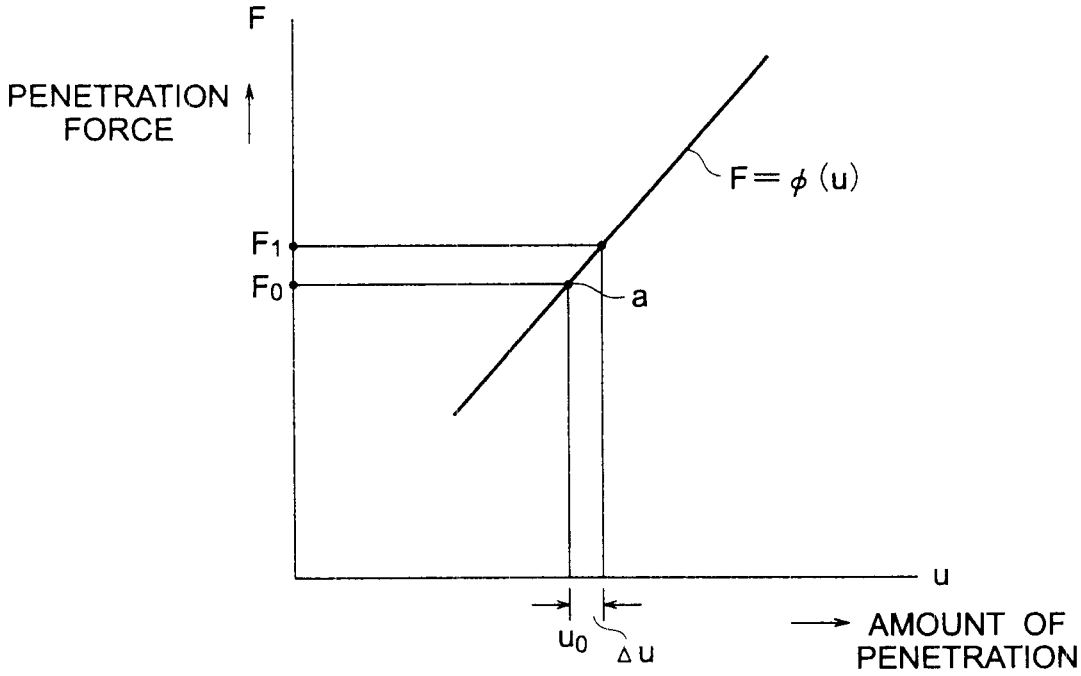
FIG. 4 is a graph showing a relation between penetration amount and penetration force.

It has been known that as the whole bit 13 is made to penetrate into an object to be crushed, such as a rock with a static thrust, a fixed relation $F=\Phi(u)$ is maintained between penetration amount u and penetration force F as shown in FIG. 4 and that also when a dynamic thrust is used, this relation substantially remains intact. In this relation, the penetration force per unit of penetration amount, that is, dF/du is referred to as penetration resistance.

If the penetration resistance of the object 7 to the bit 13 is equal in magnitude to the specific impedance Z of the rod 12, $R=(Z-Z)/(Z+Z)=0$, in other words, the reflection is 0. More specifically, all energy is transmitted to the object 7, and the load on the leading end of the bit 13 at this time is equal to f. To be more specific, at the leading end of the bit 13, only when the penetration resistance is equal to the resistance while a shock wave is transmitted through the rod 12, 100% of energy is transmitted to the object 7. Or otherwise, 100% of energy is not transmitted. When the penetration resistance is smaller than the above-mentioned reflectionless impedance, the remainder of energy is reflected as a tensile stress wave, and when the penetration resistance is larger than the reflectionless impedance, the remainder of energy is reflected as a compressive stress wave.

Figure 5:
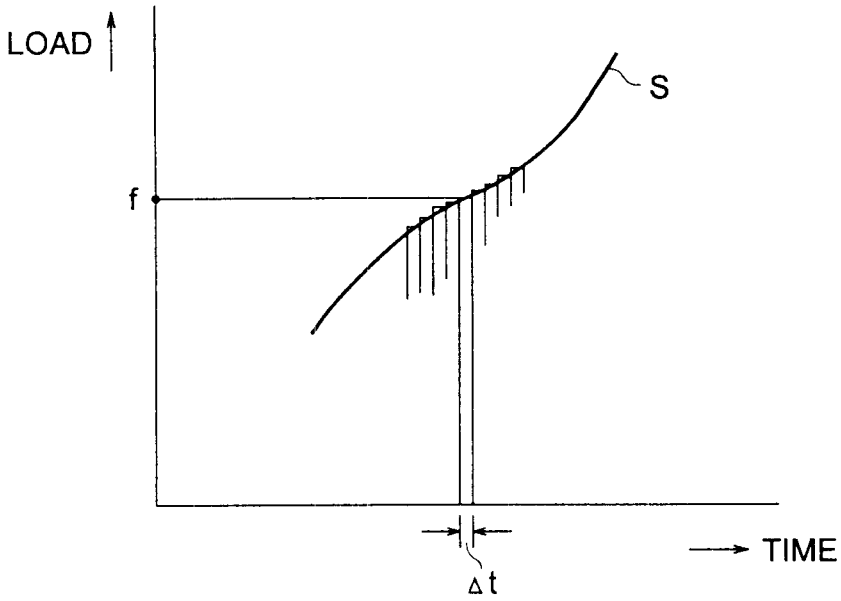
FIG. 5 is a graph showing a waveform of an incident wave.

When the shock wave reaches the leading end of the bit 13 in contact with the object 7 having a penetration resistance, the penetration of the bit 13 and the occurrence of a reflected wave from the shock wave take place. As shown in FIG. 5, with a shock wave of an arbitrary waveform, the load f appears to be constant for a very short time $\Delta t$ (several $\mu$s for example). Suppose that the penetrating bit 13 is, as shown in FIG. 4, at the position a in the relation between the penetration amount u and the penetration force F and that the penetration force at this time is $F_0=\Phi(u_0)$. If the time $\Delta t$ is small, the magnitude r of a reflected wave produced at the bit 13 can be regarded approximately as $r=F_0-f$. The leading end of the bit 13 advances by mutual superposition of an incident wave and a reflected wave. The advancing speed of the bit 13 in this time $\Delta t$ is $v=(r-f)/Z$ from $r-f=Zv$, and therefore the advancing amount of the bit 13, that is, an increase $\Delta u$ in the penetration amount is obtained by $\Delta u=(r-f)\Delta t/Z$. On completion of this penetration, the magnitude of the penetration force has increased from $F_0=\Phi(u_0)$ to $F_1=\Phi(u_0+\Delta u)$.

By repeatedly performing the above procedure, with regard to an arbitrary incident wave, it is possible to know how the penetration amount and the penetration energy to an object 7 to be crushed, which has a penetration resistance, change with passage of time.

From the above observation, it can be seen that to make the bit 13 penetrate into an object 7 like a rock with energy, such as a shock wave, it is necessary for a displacement speed v higher than a certain speed to be continued for a certain period of time from the above-mentioned equations. such as $f=Zv$, $\Delta u=v\Delta t$.

Figure 6:
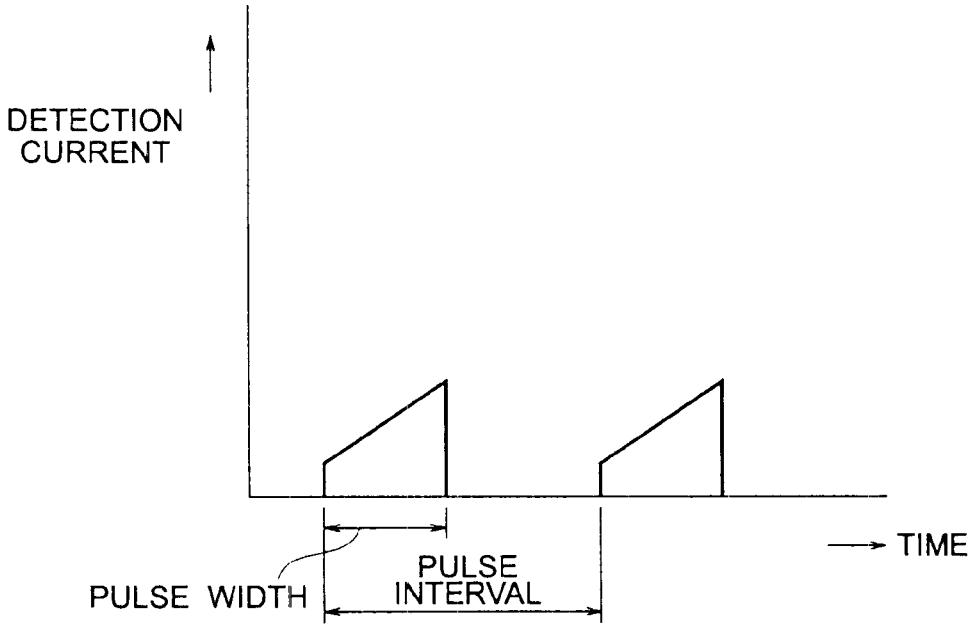
FIG. 6 is a graph showing an example of a waveform of an exciting current.

The physical properties of objects 7 to be crushed, such as a rock. are diverse and therefore they have various levels of penetration resistance. To ensure a penetration amount over a certain amount and limit required power to a certain value or less, because strain by magnetostriction is proportional to the strength of a magnetic field, in other words, the magnitude of an exciting current and the temporal change rate of strain is equal to displacement speed v, as shown in FIG. 6, a pulse voltage is repeatedly applied to the exciting coil 4 from a power unit 6 such that the exciting current of the exciting coil increases with passage of a voltage-applied time and after reaching a desired maximum value, suddenly falls to zero. By this arrangement, a desired displacement and a desired displacement speed can be achieved in deformation of a super magnetostrictive material 1 by magnetostriction. The pulse width at this time is suitably selected from a range of several tens of $\mu$s up to several hundreds of $\mu$s, and the pulse interval is suitably selected from a range of several ms up to several hundreds of ms.

When carrying out penetration of the bit 13, the leading end of the bit 13 is preferably in contact with the object 7. If the leading end of the bit 13 is not in contact with the object 7, a shock wave incident on the leading end of the bit 13 returns as a tensile stress wave into the rod 12, so that the energy cannot be effectively transmitted to the object 7. For this reason, it is required to have the whole rod 12 statically pressed against the object 7.

Figure 7:
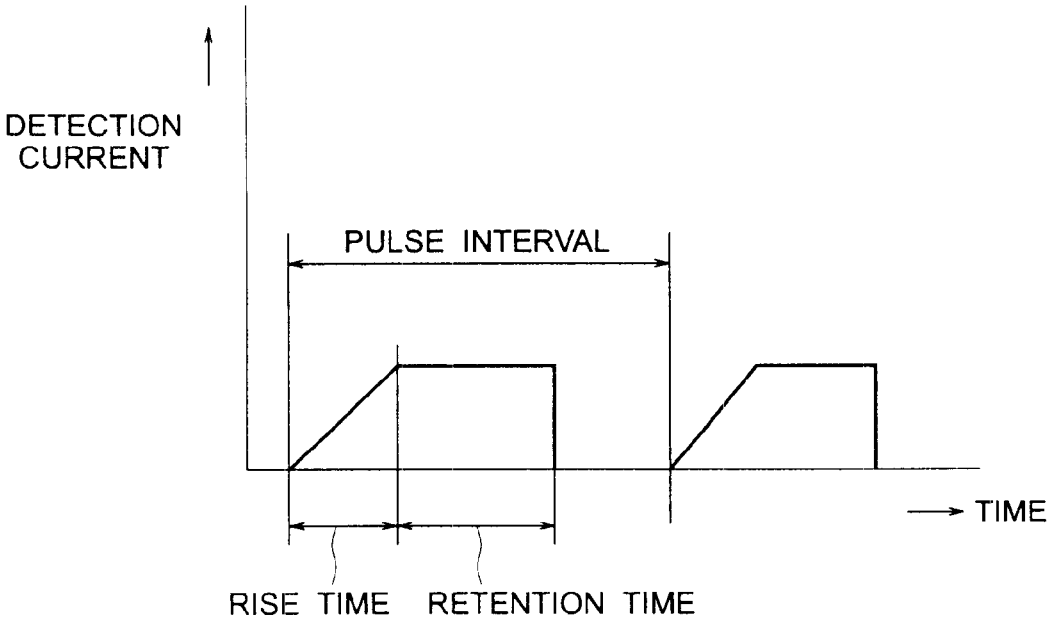
FIG. 7 is a graph showing another example of a waveform of an exciting current.

As shown in FIG. 7, if a pulse voltage is applied to the exciting coil 4 in such a way that the exciting current of the exciting coil 4, as it rises in a pulse waveform, increases with passage of a voltage-applied time, and after reaching a desired maximum value, while the exciting current maintains the maximum value for a fixed period of time, the super magnetostrictive material 1 is prolonged, making it possible for the rod 12 to be pressed against the object 7, so that an instantaneous thrust deficiency, which the thrust unit is unable to deal with, can be compensated. The time in which a fixed value is maintained may be suitable selected from a range of several tens of ms.

To make effective use of a shock wave for penetration work into the object 7, it is important to minimize the occurrence of a reflected wave. More specifically, to reduce the magnitude r of a reflected wave to zero, it is required to keep $f=-F$ (the −sign indicates a compressive stress wave) from $r=-F-f=0$.

Figure 8:
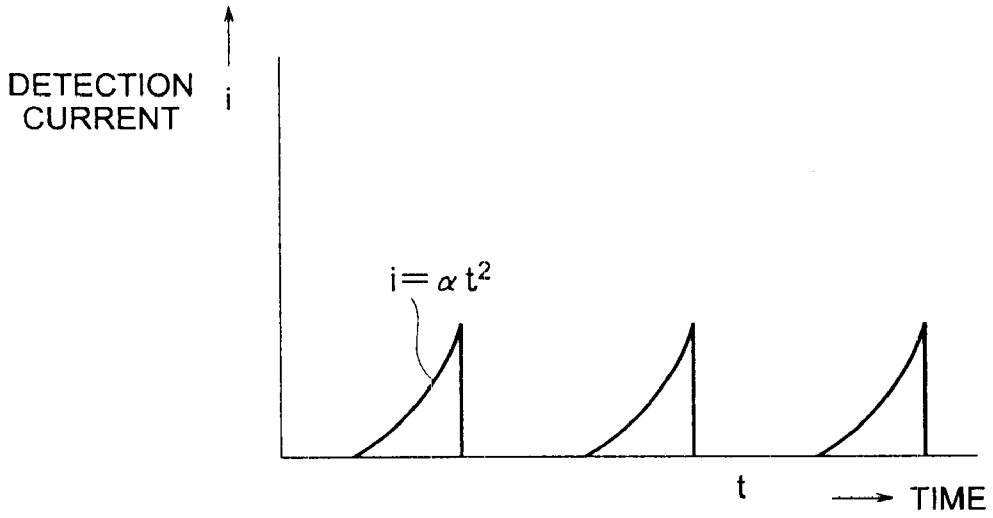
FIG. 8 is a graph showing yet another example of a waveform of an exciting current.
Figure 9:
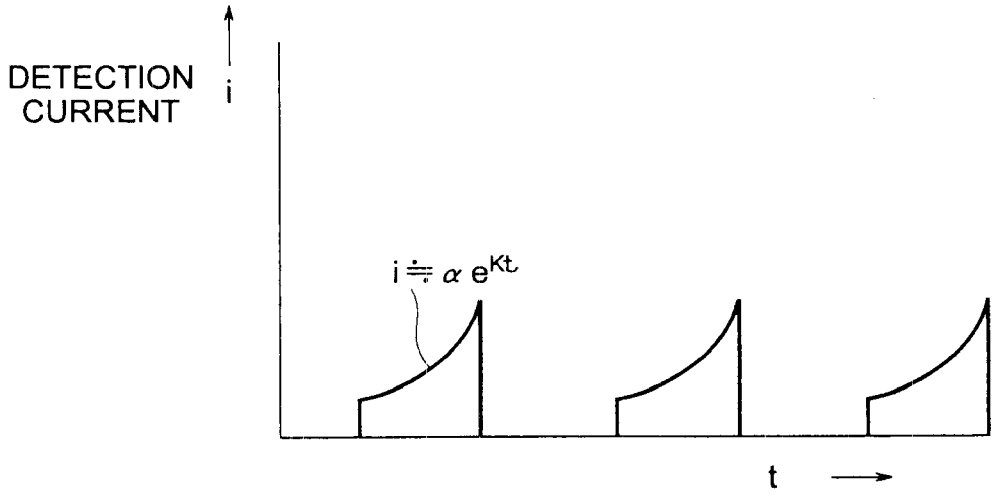
FIG. 9 is a still further example of a waveform of an exciting current.

With an object 7 for which assumption can be made that $F=\Phi(u)=ku$, we can derive $dF=-df=kdu=(k/Z)fdt$ from $v=du/dt=-f/Z$. If $f=f_0e^{(k/Z)t}$, no reflected wave occurs. If the fact that the initial $f_0$ necessary for the initial penetration and the penetration resistance of the object 7 to be crushed are not necessarily expressed correctly as $F=ku$ is taken into account, when a pulse voltage is applied to the exciting coil so that the exciting current of the exciting coil increases in proportion to an elapsed time squared ($i=\alpha t^2$) or approximately as a logarithmic function of an elapsed time ($i\approx\alpha e^{kt}$) during passage of a voltage-applied time from the initial current value at rising of a pulse waveform up to the maximum value as shown in FIGS. 8 and 9, the occurrence of a reflected wave can be minimized.

If a detection coil 8 is provided adjacent to the exciting coil 4, when a reflected wave returns from the rod 12 to the super magnetostrictive material 1, by measuring changes in current or voltage produced by magnetostriction with the detection coil 8 to detect a waveform of the reflected wave with a detection unit 9 and by increasing or decreasing the magnitude of an incident wave in the penetration process of the bit 13 into the object 7 according to the reflected wave, reflected waves can be reduced, making it possible to improve the penetration efficiency and reduce vibrations or reactions.

Figure 10:
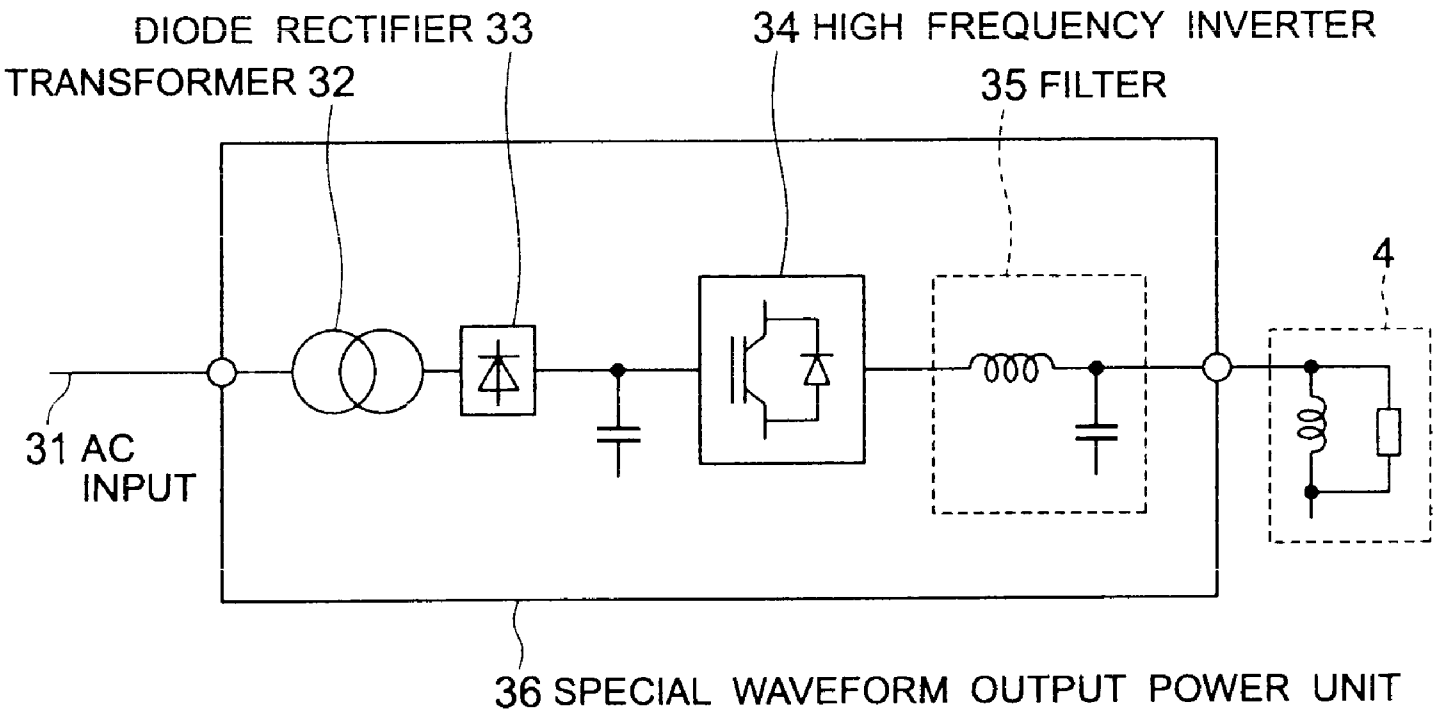
FIG. 10 is a block diagram of a special waveform output power supply.

To supply the exciting coil 4 with a pulse voltage as mentioned above, a special wave form output power unit 36 including a transformer 32, a diode rectifier 33, a high-frequency inverter 34 and a filter 35 shown in FIG. 10, capable of transforming an AC input 31 into the form of a special-waveform pulse is used as the power unit 6. The special waveform output power unit 36 controls an applied voltage so as to obtain a pulse current of a desired waveform according to inductance of the electric circuits and detection results by the detection unit 9 with respect to the waveform of a reflected shock wave.

INDUSTRIAL APPLICABILITY

As is obvious from the above description, the impacting device according to the present invention directly converts electric energy into strain energy and therefore has a high energy efficiency and does not require hydraulic equipment, hydraulic piping and complicated mechanical devices, such as a hydraulic striking mechanism, this impacting device can simplify the impact machine.

It becomes possible to operate the impact machine at high speed by electric pulse and more easily produce high output than in the mechanical piston striking operation. Being capable of easy production of a desired impact waveform, this impacting device improves penetration efficiency and crushing efficiency.

This impact machine measures a reflected wave by deformation of the super magnetostrictive material, and reflects detection results in the output waveform, making it possible to reduce reflected waves, improve penetration efficiency and decrease vibrations and reactions. Above all, because striking noise is eliminated, it is possible to provide a quiet, high-durability impact machine.

What is claimed is:

1. An impacting device comprising:

an exciting coil actuated by application of a pulse voltage;

a super magnetostrictive material arranged in the center of said exciting, coil;

an impact-transmitting tool in tight contact with a leading end of said super magnetostrictive material;

a reaction-receiving plate in tight contact with the opposite end of said super magnetostrictive material; and a power unit for repeatedly applying to said exciting coil a pulse voltage such that an exciting current of said exciting coil increases in proportion to an elapsed time squared or approximately as a logarithmic function during passage of a voltage-applied time from an initial value to a maximum value.

2. An impacting device according to claim 1, further comprising a detection unit having a detection coil provided adjacent to said exciting coil, wherein when a reflected wave returns from said impact-transmitting tool to said super magnetostrictive material, said detection unit detects a waveform of the reflected wave by measuring changes in current or voltage by magnetostriction with said detection coil.

3. An impacting device according to claim 1 wherein the exciting current, after reaching the desired maximum value, suddenly falls to zero.

4. An impacting device according to claim 3, further comprising a detection unit having a detection coil provided adjacent to said exciting coil, wherein when a reflected wave returns from said impact-transmitting tool to said super magnetostrictive material, said detection unit detects a waveform of the reflected wave by measuring changes in current or voltage by magnetostriction with said detection coil.

5. An impacting device according to claim 1 wherein the exciting current, after reaching the desired maximum value, maintains a maximum value for a specified time and then suddenly falls to zero.

6. An impacting device according to claim 5, further comprising a detection unit having a detection coil provided adjacent to said exciting coil, wherein when a reflected wave returns from said impact-transmitting tool to said super magnetostrictive material, said detection unit detects a waveform of the reflected wave by measuring changes in current or voltage by magnetostriction with said detection coil.

7. An impacting device comprising:

an exciting coil actuated by application of a pulse voltage;

a super magnetostrictive material arranged in the center of said exciting coil;

an impact-transmitting tool in tight contact with a leading end of said super magnetostrictive material;

a reaction-receiving plate in tight contact with the opposite end of said super magnetostrictive material; and a detection unit having a detection coil provided adjacent to said exciting coil, wherein when a reflected wave returns from said impact-transmitting tool to said super magnetostrictive material, said detection unit detects a waveform of the reflected wave by measuring changes in current or voltage by magnetostriction with said detection coil.

8. An impacting device according to claim 7, further comprising a power unit for repeatedly applying to said exciting coil a pulse voltage such that an exciting current of said exciting coil increases with passage of a voltage-applied time, and after reaching a desired maximum value, suddenly falls to zero.

9. An impacting device according to claim 7, further comprising a power unit for repeatedly applying to said exciting coil a pulse voltage such that an exciting current of said exciting coil increases with passage of a voltage-applied time, and after reaching a desired maximum value, maintains a maximum value for a specified time and then suddenly falls to zero.

* * * * *